US005397058A

United States Patent [19]

Zanetti

[11] Patent Number: 5,397,058

[45] Date of Patent: Mar. 14, 1995

[54] LOW PRESSURE FUMELESS SPRAY GUN

[75] Inventor: Paolo Zanetti, Conegliano, Italy

[73] Assignee: Asturo MEC S.R.L., Milan, Italy

[21] Appl. No.: 133,309

[22] Filed: Oct. 8, 1993

[51] Int. Cl.[6] ..... B05B 7/04; B05B 7/30

[52] U.S. Cl. ..... 239/290; 239/354; 239/369; 239/417.3; 239/419

[58] Field of Search ..... 239/290, 409, 417.3, 239/419, 427.3, 302, 337, 340, 354, 369

[56] References Cited

U.S. PATENT DOCUMENTS

| | | | |
|---|---|---|---|
| 1,767,822 | 6/1930 | Thompson | 239/369 X |
| 2,214,035 | 9/1940 | Tracy | 239/290 X |
| 2,263,842 | 11/1941 | Gross | 239/340 X |
| 2,526,405 | 10/1950 | Peeps | 239/290 X |
| 2,530,206 | 11/1950 | Nieburg | 239/419 X |
| 3,764,069 | 10/1973 | Runstadler, Jr. et al. | 239/419 X |
| 4,760,962 | 8/1988 | Wheeler | 239/354 X |
| 5,170,941 | 12/1992 | Morita et al. | 239/290 X |

FOREIGN PATENT DOCUMENTS

| | | | |
|---|---|---|---|
| 488243 | 12/1929 | Germany | 239/290 |

*Primary Examiner*—William Grant
*Attorney, Agent, or Firm*—Hoffman, Wasson & Gitler

[57] ABSTRACT

A low pressure fumeless spray gun comprising an atomizer (3) with a central nozzle (8) having a sized orifice concentric with the feed duct (9) for the liquid to be atomized, and a sleeve (14) surrounding the nozzle (8) and comprising at least a channel (15) by which compressed air is fed into the region downstream of the atomization region, characterised by further comprising a plurality of compressed air feed channels (11) communicating with the liquid feed duct (9) upstream of the atomization region.

2 Claims, 1 Drawing Sheet

LOW PRESSURE FUMELESS SPRAY GUN

This invention relates to a low pressure fumeless spray gun.

Fumeless spray guns of low pressure operation (about 500 mbar) are known comprising a handgrip through which compressed air flows, and an atomizer with a central nozzle having a sized orifice concentric with the paint feed tube. The high velocity achieved by the compressed air as it expands within the nozzle causes the paint to be drawn in, atomized and expelled in the form of mist. To prevent dispersal of the atomized paint into the environment, the nozzle is provided with a sleeve comprising an annular channel for an additional air jet forming a cone which surrounds the paint stream.

These known spray guns have however certain drawbacks, and in particular:

unsatisfactory atomization due to the working conditions (low pressure), so that such spray guns cannot be used for work requiring a high degree of atomization, such as vehicle body spraying, substantial energy consumption to achieve atomization.

An object of the invention is to obviate these drawbacks by providing a spray gun which although operating at low pressure achieves an atomization comparable with that of high pressure spray guns.

A further object of the invention is to provide a spray gun of low compressor energy absorption.

These and further objects which will be more apparent from the ensuing description are attained according to the invention by a low pressure fumeless spray gun having an atomizer with a central nozzle with a sized orifice concentric with a feed duct for liquid to be atomized. A sleeve surrounds the nozzle and has at least one channel for communicating compressed air into the region downstream of the atomized region, and also includes multiple compressed air feed channels which communicate with the fluid feed duct upstream of the atomized region.

A preferred embodiment of the present invention is described hereinafter with reference to the accompanying drawings, in which.

Figure 1:
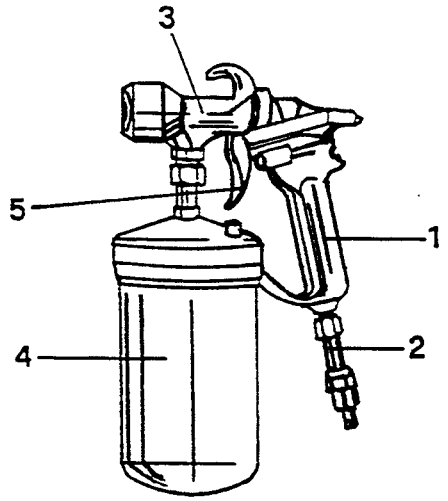
FIG. 1 is a perspective view of a spray gun according to the invention.
Figure 2:
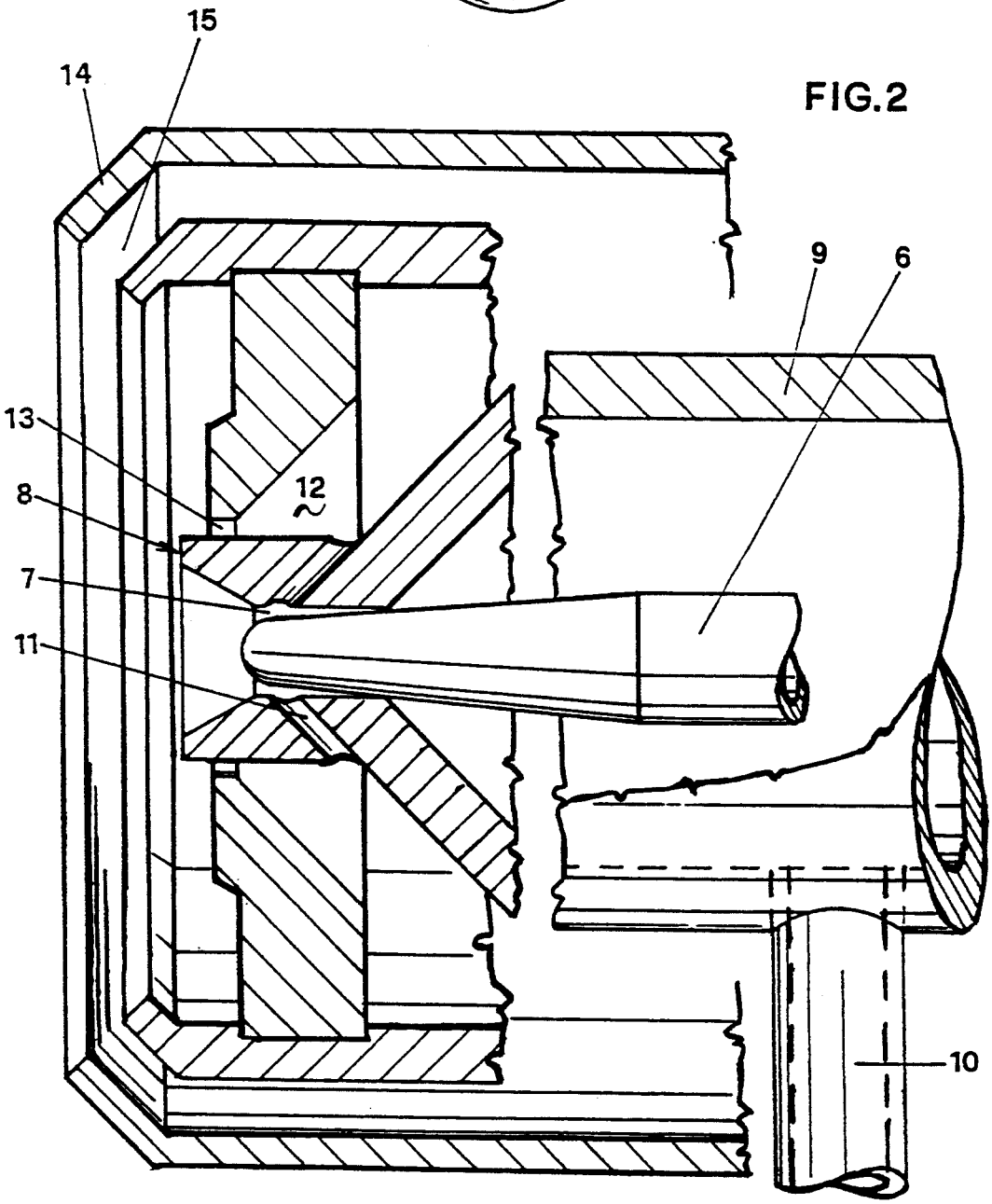
FIG. 2 is an enlarged detailed longitudinal section through the nozzle.

As can be seen from the figures, the spray gun according to the invention comprises substantially a handgrip 1 provided with a quick-fitting connector 2 for connection to a compressed air main, and an atomizer 3 fixed to a container 4 containing the liquid to be sprayed.

The handgrip 1 is provided with a trigger 5 acting on a stem 6, the head of which is housed in a corresponding seat 7 provided in a nozzle 8. The nozzle 8 communicates with a duct 9 leading to a tube 10 which has its other end inserted into the container 4 and immersed in the liquid.

Four ducts 11 extend from the seat 7 to an annular duct 12 provided with exit holes 13. The nozzle 8 is surrounded by a projecting sleeve 14 comprising an annular cavity 15. The annular duct 12 and the annular cavity 15 communicate with duct 12 and the annular cavity 15 communicate with the compressed air main.

The spray gun according to the invention is used as follows:

When the user operates the trigger 5, the stem 6 is withdrawn and a valve is opened to allow air to enter the spray gun. The air enters the atomizer and leaves through the cavity 15 and the holes 13 of the nozzle, by which:

the container 4 is put under vacuum to draw in a certain quantity of liquid, which mixes with the air passing through the ducts 11 and into the seat 7 for the stem 6, the air leaving the holes 13 is atomized with the previously formed air/liquid mixture, an air cone is formed by the cavity 15, to surround the atomized paint conveyed onto the surface to be coated.

Experimental tests show not only that the same atomizing effect is obtained for a smaller quantity of air absorbed (about 50%) and hence for a lesser compressor energy consumption, but also that the atomization is efficient although operating at low pressure.

This is due to the fact that the air leaving through the holes 13 draws with it not liquid alone but instead the liquid/air mixture which has formed within the seat 7 and hence a mixture of lesser density, which therefore requires a smaller air quantity for its atomization.

It is claimed:

1. A low pressure fumeless spray gun comprising an atomizer (3) having a sized hole nozzle (8) disposed in a central position and concentric to a duct (9) conveying fluid to be atomized to said nozzle (8), said fluid to be atomized being stored in a container (4) under substantially atmospheric pressure, and a sleeve (14) surrounding said nozzle (8) forming an annular cavity (15) connected to an annular compressed air duct (12) and conveying compressed air to an area downstream from said nozzle (8), said air duct (12) being provided with at least one exit hole (13), and a plurality of compressed air feed channels (11) extending between said annular duct (12) and the interior of said nozzle (8), the flow of compressed air through said air feed channels (11) causing said fluid to be atomized to be drawn from said container (4) into said nozzle (8) forming a fluid to be atomized/air mixture, such that air leaving said at least one exit hole (13) draws with it said mixture and atomizes said mixture, said atomized mixture being surrounded by compressed air exiting said annular cavity (15).

2. A spray gun as claimed in claim 1, wherein said channels (11) communicate with a seat (7) for a head of a spray gun stem (6) within said nozzle (8).

* * * * *